US006998155B2

(12) United States Patent
Haggquist et al.

(10) Patent No.: US 6,998,155 B2
(45) Date of Patent: Feb. 14, 2006

(54) WOVEN MATERIALS WITH INCORPORATED SOLIDS AND PROCESSES FOR THE PRODUCTION THEREOF

(75) Inventors: Gregory W. Haggquist, Longmont, CO (US); Richard A. Mellor, Otley (GB)

(73) Assignee: TrapTek LLC, Longmont, CO (US)

( * ) Notice: Subject to any disclaimer, the term of this patent is extended or adjusted under 35 U.S.C. 154(b) by 59 days.

(21) Appl. No.: 09/864,348

(22) Filed: May 23, 2001

(65) Prior Publication Data

US 2003/0060106 A1 Mar. 27, 2003

(51) Int. Cl.
*B05D 1/12* (2006.01)
*B05D 3/06* (2006.01)

(52) U.S. Cl. ..... 427/513; 427/174; 427/201; 427/202; 427/296; 427/345

(58) Field of Classification Search ..... 427/180, 427/201, 174, 513, 516, 521, 294, 296, 345, 427/202; 156/279–280
See application file for complete search history.

(56) References Cited

U.S. PATENT DOCUMENTS

| | | | | |
|---|---|---|---|---|
| 3,783,085 A | | 1/1974 | Pearson et al. | |
| 4,004,324 A | | 1/1977 | Bridge et al. | 19/156.3 |
| 4,099,186 A | | 7/1978 | Edwards et al. | 346/74.1 |
| 4,175,055 A | * | 11/1979 | Goller et al. | |
| 4,244,059 A | | 1/1981 | Pflaumer | |
| 4,396,663 A | | 8/1983 | Mitchell et al. | 428/111 |
| 4,455,187 A | | 6/1984 | Blücher et al. | |
| 4,457,345 A | | 7/1984 | Bl ücher et al. | |
| 4,496,415 A | | 1/1985 | Sprengling | 156/283 |
| 4,510,193 A | | 4/1985 | Blücher et al. | |
| 4,551,191 A | | 11/1985 | Kock et al. | 156/276 |
| 4,610,905 A | | 9/1986 | Blücher et al. | |
| 4,920,168 A | | 4/1990 | Nohr et al. | 524/188 |
| 5,037,412 A | | 8/1991 | Tanzer et al. | |
| 5,300,192 A | | 4/1994 | Hansen et al. | |
| 5,300,357 A | | 4/1994 | Gardiner | 428/224 |
| 5,308,896 A | | 5/1994 | Hansen et al. | |
| 5,334,414 A | | 8/1994 | Edie et al. | 427/189 |
| 5,334,436 A | | 8/1994 | Hobbs et al. | 428/195 |
| 5,338,340 A | | 8/1994 | Kasmark, Jr. et al. | 96/135 |
| 5,342,333 A | | 8/1994 | Tanzer et al. | |
| 5,352,480 A | | 10/1994 | Hansen et al. | |
| 5,364,380 A | | 11/1994 | Tanzer et al. | |
| 5,383,236 A | | 1/1995 | Sesselmann et al. | |
| 5,432,000 A | | 7/1995 | Young et al. | |
| 5,447,977 A | | 9/1995 | Hansen et al. | |

(Continued)

FOREIGN PATENT DOCUMENTS

| | | | |
|---|---|---|---|
| GB | 2238802 | * | 6/1993 |

(Continued)

*Primary Examiner*—Fred J. Parker
(74) *Attorney, Agent, or Firm*—Fish & Neave IP Group of Ropes & Gray LLP; Andrew Van Court

(57) ABSTRACT

The invention relates woven and knit materials with an incorporated particulate solid and to a process for producing woven materials incorporated with a particulate solid. The process comprises: entraining a particulate solid in a gaseous carrier; disposing one face of a woven material in the path of a stream of said gaseous carrier and entrained particulate solid; maintaining a pressure drop across the woven material from said one face to the other face of said material, thereby to obtain a woven material with at least some of the entrained particulate solid in the gaseous carrier; and fixing the incorporated particulate solid.

28 Claims, 6 Drawing Sheets

U.S. PATENT DOCUMENTS

| | | | | |
|---|---|---|---|---|
| 5,462,538 | A | | 10/1995 | Korpman |
| 5,498,478 | A | | 3/1996 | Hansen et al. |
| 5,538,783 | A | | 7/1996 | Korpman |
| 5,539,930 | A | | 7/1996 | Sesselmann ..... 2/243.1 |
| 5,571,618 | A | | 11/1996 | Hansen et al. |
| 5,582,644 | A | | 12/1996 | Gaddis et al. |
| 5,589,256 | A | | 12/1996 | Hansen et al. |
| 5,591,146 | A | | 1/1997 | Hasse |
| 5,603,992 | A | | 2/1997 | Woodhall et al. ..... 427/534 |
| 5,609,727 | A | | 3/1997 | Hansen et al. |
| 5,614,570 | A | | 3/1997 | Hansen et al. |
| 5,681,305 | A | | 10/1997 | Korpman |
| 5,766,443 | A | * | 6/1998 | Hillrichs et al. |
| 5,790,987 | A | | 8/1998 | Sesselmann ..... 2/243.1 |
| 5,804,625 | A | | 9/1998 | Temperante et al. ..... 524/188 |
| 5,811,045 | A | | 9/1998 | Pike ..... 264/168 |
| 5,863,305 | A | | 1/1999 | Beardsley et al. ..... 51/294 |
| 5,885,681 | A | | 3/1999 | Korpman |
| 5,951,534 | A | | 9/1999 | Cummings et al. |
| 6,007,590 | A | | 12/1999 | Sanders, Jr. ..... 51/295 |
| 6,009,559 | A | | 1/2000 | Sesselmann ..... 2/243.1 |
| 6,017,831 | A | | 1/2000 | Beardsley et al. ..... 442/68 |
| 6,057,072 | A | | 5/2000 | Guistina et al. ..... 430/106 |
| 6,134,718 | A | | 10/2000 | Sesselmann |
| 6,207,255 | B1 | | 3/2001 | Fukuura et al. ..... 428/175 |
| 6,350,492 | B1 | | 2/2002 | Gillick et al. ..... 427/407.1 |
| 6,426,025 | B1 | | 7/2002 | Goeman ..... 264/103 |
| 6,541,554 | B1 | | 4/2003 | Morin et al. ..... 524/387 |
| 6,641,842 | B1 | | 11/2003 | Laridon et al. ..... 424/486 |
| 6,656,404 | B1 | | 12/2003 | Morin et al. ..... 264/210.5 |

FOREIGN PATENT DOCUMENTS

| | | | |
|---|---|---|---|
| GB | 2238802 B | | 10/1993 |
| WO | 98/42909 | * | 10/1998 |
| WO | WO 98/42909 | | 10/1998 |
| WO | WO 01/05583 A1 | | 1/2001 |
| WO | WO 01/18305 A1 | | 3/2001 |

* cited by examiner

WOVEN MATERIALS WITH INCORPORATED SOLIDS AND PROCESSES FOR THE PRODUCTION THEREOF

TECHNICAL FIELD OF THE INVENTION

The present invention relates to woven and knit materials and to producing and using such materials. More particularly, the present invention relates to woven and knit materials with an incorporated particulate solid and to processes for the production and use of such materials.

BACKGROUND OF THE INVENTION

There are a number of reasons why it may be desirable to produce materials, particularly woven or knit materials, (hereinafter "woven materials") with incorporated particulate solids. The particulate solid may, depending on its nature, impart desirable chemical or physical properties to the woven material which may find use in a number of commercial applications. For example, it may be desirable to provide a woven material with an incorporated particulate solid having odor-adsorbing properties. Such a woven material could be particularly useful in garment manufacture for the purpose of adsorbing unpleasant odors caused by sweat, bodily emissions, the surrounding environment, or odors inherent in or caused by the fabric itself. One such particulate solid having odor-adsorbing properties is activated carbon. Other possible uses include, but are not limited to, incorporation of particulate solids imparting fire retardance, improved moisture management, improved UV absorption, antibacterial, antifungal or antimicrobial features to the resulting material. Such garments may be desirable for use in, for example, active clothing, active wear or sporting wear and/or other uses in which, for example, the wearer seeks to prevent his or her odor from being detected. Other possible uses may include combinations of any of the above.

The use of a woven material, as opposed to a non-woven material, is preferred because of the inherent advantageous wearability, comfort and style characteristics of woven materials in comparison to non-woven materials. Non-woven materials typically lack the stretchability and breathability of woven materials, and are often less comfortable than woven materials. Consequently, uses of non-woven materials in clothing are more limited than uses of woven materials.

Despite many known methods of impregnating non-woven materials with particulate solids, none has been successfully applied to produce a woven material with incorporated particulate solids, or to produce such a woven material suitable for garment manufacture.

These methods have the disadvantage of either not being applicable to woven materials or not providing a satisfactory woven material. More particularly, methods for impregnating non-woven materials with particulate solids have not been successfully used with woven materials for the following reasons.

First, many non-woven methods, such as liquid dispersion or suspension methods, result in encapsulation and consequent deactivation of the particulate solid. Such processes would have the same disadvantages if practiced on woven materials.

Second, methods involving tackifying or plasticizing a non-woven surface to facilitate impregnation with particulate solids result in fabrics that take on the properties of the binder and particulate solid rather than the fabric. Such processes would have the same disadvantages if practiced on woven materials. Furthermore, tackifying or plasticizing a woven material would ruin the woven nature of the fabric, resulting in an undesirable material.

Third, methods involving impregnating particulate solids dispersed or suspended in a gas stream into the pores of a non-woven material were believed to be inoperable with materials, such as woven materials, that lack the pore structure in non-woven materials.

An alternative to impregnating a woven material with a particulate solid is to form a laminate of the particulate solid between two sheets of woven cloth. In one method, a particulate solid is applied to one of the woven sheets as a free flowing powder before the two woven sheets are laminated. This method, however, does not firmly bind the particulate solid to the woven sheets. Consequently, the particulate solid can shake out of the laminate during, for example, normal washing of the material. Furthermore, this method can only be applied in cases where the outer woven sheets have a much smaller open space in their weave than the mean particle size of the particulate solid. As a result, this method typically requires the use of granular materials rather than powders.

Therefore, there is a need for a woven material with an incorporated particulate solid and for a method capable of incorporating a particulate solid into a woven material without deactivating the particulate solid, causing the woven material to take on the characteristics of the particulate solid, or causing the woven material to become non-woven in nature.

SUMMARY OF THE INVENTION

It is an object of the present invention to provide a woven material with an incorporated particulate solid or solids.

It is another object of the present invention provide a process for producing a woven material with an incorporated particulate solid or solids.

It is a further object of the invention to provide such a process which (1) is commercially viable, (2) does not result in substantial loss of activity of the particulate solid material, and/or (3) operates on woven materials to result in a material that retains the beneficial properties of a woven material.

BRIEF DESCRIPTION OF THE DRAWINGS

FIG. 1 depicts a part of the process wherein particulate solid is incorporated into a base material.

FIG. 2 depicts a part of the process in which binder is used to fix the incorporated particulate solid to the woven material.

FIG. 2*a* illustrates a part of the process in which infra-red energy is used to fix the incorporated particulate solid to the woven material.

DETAILED DESCRIPTION OF THE INVENTION

Figure 1:
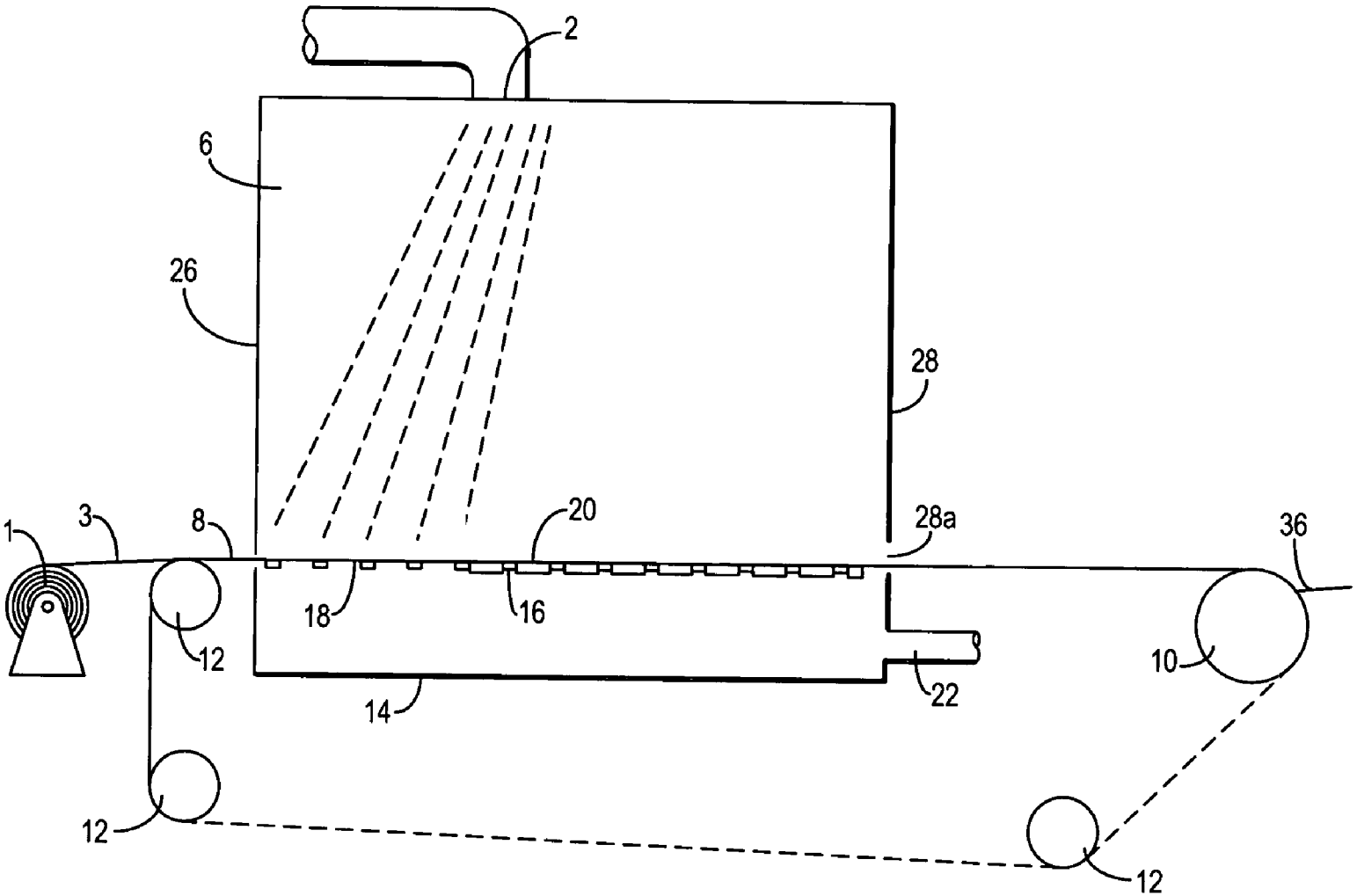
FIGS. 1, 2 and 2*a* illustrate schematically how a process of the present invention may be practiced.

It is an object of the present invention to provide a woven material with an incorporated particulate solid or solids and to provide a process for producing and using such materials.

As used herein, a woven material refers to any material held together mechanically by looping the constituent yarns around each other in a non-random manner. The term woven is intended to refer to (1) classical woven materials in which a material is composed of two yarns, known as the warp and the weft (or fill); and to (2) knitted materials which generally consist of yarns that run in the same direction rather than perpendicular directions and, like classical woven materials, are held together mechanically. Examples of woven materials include, but are not limited to, fabric materials, such as those used in apparel applications, and sheet materials, such as those used in non-apparel applications. The term yarn is intended to refer to any continuous strand of material, such as, for example, yarn, fiber, thread, or string.

In contrast, a non-woven material is made by fusing fibers together. This results in a random three-dimensional structure containing free volume, or pores. These pores have a wide range of volumes. This internal pore structure results in gas, liquid and solid permeability of the non-woven material.

Solid particulates used for the impregnation of non-woven materials must be smaller in diameter than the pore size in the non-woven material (and are typically half the diameter of the mean pore size). Thus, the non-woven material must have a minimum thickness that is greater than its pore diameter (typically 10 times the mean pore diameter). This requirement sets a lower limit on the thickness of the non-woven material necessary to achieve particulate impregnation.

In contrast, woven and knitted materials do not contain non-woven pore-like structures. Woven and knitted materials are made by weaving and knitting yarns and/or fibers into a regular structure. This regular pattern of weaving and knitting creates free volume (referred to herein as "gaps") between the woven or knitted yarns, permitting gases, liquids and solids to flow through the woven material. However, these gaps differ from the pores in a non-woven material. The gaps in a woven material are regular and can be classified as two dimensional, while the pores in a non-woven material are random and three-dimensional. The size of the gaps in a woven material are dependent on the type of weave or knit being used and the diameter of the yarn or fiber.

It is desirable to have a material that, unlike a non-woven material, does not have a minimum thickness requirement based on pore size. One advantage of the present invention over the prior art is that it does not have a minimum thickness requirement based on pore size. Thus, a wider range of materials and weights of materials may be used in a process of this invention.

Accordingly, one embodiment of the present invention provides a process for producing a woven material with an incorporated particulate solid or solids which process comprises: entraining a particulate solid or solids in a gaseous carrier; disposing a first face of a woven material in the path of a stream of said gaseous carrier and entrained particulate solid; maintaining a pressure drop across the woven material from the first face to a second face of said material, thereby incorporating into the woven material at least some of the entrained particulate solid in the gaseous carrier; and fixing the incorporated particulate solid on and/or in the woven material.

A wide variety of woven materials may be used in a process of this invention. In one embodiment, the weight of the woven material used is less than or equal to about 20 oz/yd$^2$ (678.0 g/m$^2$). In another embodiment, the weight of the woven material used is from about 1 oz/yd$^2$ (33.9 g/m$^2$) to about 20 oz/yd$^2$ (678.0 g/m$^2$). In other embodiments, the weight of the woven material is from about 2 oz/yd$^2$ to about 20 oz/yd$^2$, about 3 oz/yd$^2$ to about 20 oz/yd$^2$, about 1 oz/yd$^2$ to about 7 oz/yd$^2$, about 2 oz/yd$^2$ to about 7 oz/yd$^2$, about 3 oz/yd$^2$ to about 7 oz/yd$^2$, or about 100 g/m$^2$ to about 400 g/m$^2$ (i.e., 2.95 oz/yd$^2$ to about 11.80 oz/yd$^2$). Preferably, the weight of the woven material is about 3 oz/yd$^2$, about 4 oz/yd$^2$, about 5 oz/yd$^2$, about 6 oz/yd$^2$, or about 7 oz/yd$^2$.

Suitable sheets of air-permeable woven materials for use in a process of the present invention include, but are not limited to, natural or synthetic woven materials. In contrast to processes involving non-woven materials, which require a minimum thickness, the process of the present invention can use woven materials having a wide range of thicknesses. In one embodiment, the woven material has any desired thickness up to about 50 mm. The thickness of the woven material depends on the type of yarn/fiber and weave/knit that is used. Preferably, the woven material has a thickness below about 3 mm, more preferably below about 2 mm, and most preferably below about 1 mm.

It has surprisingly been found that retention of the particulate solid on the woven material is such that % w/w loadings of particulate solid (weight of solid/weight of woven material) of over 70% can be achieved with woven materials having a weight of 3 oz/yd$^2$ or less while maintaining high air and moisture permeability. With woven materials, unlike with non-woven materials, such performance can be achieved even at thicknesses below 1 mm.

The targeted particulate solid loading is based on the intended end use of the product. Many end uses do not require loadings as high as 70% w/w. A low particulate solid loading would be generally about 10% w/w. Accordingly, in certain embodiments of this invention, loadings from (or of) about 10% to (or of) about 50%, from about 10% to (or of) about 70% w/w, from (or of) about 20% to about 50%, from about 20% to about 70%, from (or of) about 30% w/w to about 50%, or from about 30% to about 70% can be produced as desired.

However, loadings as low as 1% w/w may be obtained by adjusting the process parameters and the apparatus described herein. Therefore, in other embodiments of this invention, the loading would be from (or of) about 1% w/w to (or of) about 5% w/w and preferably from (or of) about 2% w/w to about 5% w/w.

It has surprisingly been found that as long as the gap of the woven material used in a process of the present invention is less than the average particle size of the particulate solid used, the actual particle size of the particulate solid will have only a small effect on incorporation of the particulate solid in the woven material. Therefore, particulate solids within a wide range of particle sizes and bulk densities are suitable for use in the present invention. Suitable particulate solid average particle sizes are, for example, from about 0.1 $\mu$m to about 400 $\mu$m, from about 0.1 $\mu$m to about 10 $\mu$m, from about 6 $\mu$m to about 400 $\mu$m, or from about 6 $\mu$m to about 10 $\mu$m. Preferred particulate solid particle sizes are from about 6 $\mu$m to about 10 $\mu$m.

The processes of the present invention can be used in a number of applications where it is desirable to incorporate particulate solid(s) into a woven material. Examples include, but are not limited to: (1) incorporating an odor-adsorbing particulate solid in a woven material for use in the manufacture of clothing; (2) incorporating a fire-retardant particulate solid into a woven material to produce fire-retardant materials; (3) incorporating a particulate solid to enhance wicking, UV absorption, antibacterial, antifungal or antimicrobial properties; and (4) incorporating whitening or other coloring agents. Applications include any one or any combination (i.e., any two or more) of the above.

Examples of particulate solids that are useful in the processes of this invention include, but are not limited to, activated carbon, graphite, silica gel, activated alumina (aluminum oxide), aluminum trihydrate, pot ash, baking soda, paramethoxy 2-ethoxyethylester cinnamic acid (cinoxate), zinc oxide, and titanium dioxide. Preferably, the particulate solids used are substantially free of impurities. More preferably, the particulate solid is substantially free of fibrous material.

As stated above, incorporated particulate solids may enhance the wicking performance of a woven material. Depending on the type and level of particulate solid incorporated, and the fabric being treated, the wicking height of the treated material in a preferred embodiment measured at any given time may be at least about 1.1 times that of the base untreated material. In a more preferred embodiment, the wicking height of the treated material measured at any given time may be at about 1.1 times to about 5 times that of the base untreated material. In this way, woven materials with wicking performance superior to that of non-woven materials or untreated woven materials can be achieved. This improved wicking performance was an unexpected result.

Accordingly, in one embodiment of this invention is provided a woven material with a wicking height of about 100% to about 400% greater than the wicking height of the corresponding woven material without an incorporated particulate solid. In a preferred embodiment, the woven material has a wicking height of about 120% greater than the wicking height of the woven material without an incorporated particulate solid. In another preferred embodiment, the woven material has a wicking height of about 380% greater than the wicking height of the woven material without an incorporated particulate solid.

As stated above, incorporated particulate solids may also to enhance UV absorption. Depending on the type and level of particulate solid incorporated and the fabric being treated, the UV absorption of the treated material in a preferred embodiment may be about 1.1 times that of the base untreated material. In a more preferred embodiment the UV absorption of the treated material may be about 1.1 times to about 5 times that of the base untreated material. In this way, woven materials with UV absorption performance far superior to that of non-woven materials or untreated woven materials can be achieved. This improved UV absorption performance was an unexpected result.

Accordingly, in one embodiment of this invention is provided a woven material with a UV adsorption value of about 2- to about 10-times greater than the UV adsorption value of the woven material without an incorporated particulate solid. In a preferred embodiment, the woven material has a UV adsorption value of about 3- to about 4-times greater than the UV adsorption value of the woven material without an incorporated particulate solid.

The air and moisture permeability of the impregnated woven fabric will depend on the weight of the fabric, the diameter of the yarn or fiber, the diameter and loading of particulate solid, the type of particulate solid, and the amount and type of binder, if any, incorporated. These parameters can be varied to achieve the desired air and moisture permeability.

A process of this invention includes a pressure drop across the woven material from the first face to the second face, with higher pressure at the first face. The distribution of the pressure drop across the woven material determines the uniformity of the incorporation of particulate solids. It is desirable to achieve a uniform incorporation of particulate solids. The uniformity of incorporation may be controlled by altering the pressure distribution across the width and the length of the woven material. There are many methods of altering the pressure distribution across the woven material. For example, slats may be used to dampen air flow. This allows a fine degree of control over the direction of flow of entrained particulate solid through the woven material, resulting in superior incorporation of the particulate within the weave. There may be two sets of slats that are perpendicular to each other. Although a process according to this invention may be carried out in the absence of slats, or other pressure distribution control, this could diminish the uniformity of particle incorporation.

In a process of the present invention, a pressure drop across the woven material (from the first face to the second face) may be achieved by maintaining a lower pressure at the second face of the woven material than at the first face of the woven material. This pressure drop may be achieved by applying suction to the second face of the woven material.

The processes of the present invention can be operated batchwise or continuously. In a preferred embodiment, a process of the invention operates continuously and includes continuously feeding the woven material between (1) a supply zone in which the stream of gaseous carrier and the entrained particulate solids are supplied directly to the first face of the woven material, and (2) a suction zone for applying suction to the second face of the woven material. Preferably, the suction zone is of variable effective length and width and is established adjacent and in line with the outlet of the supply zone. This allows the use of materials having varying widths.

In another preferred embodiment, the effective length and width of the suction zone is greater than the effective length and width of the supply zone. This facilitates uniform particulate solid incorporation by minimizing the formation of turbulent air flows in the incorporation zone. This also prevents unnecessary loss of materials to the external environment.

In another preferred embodiment, in the suction zone, a pressure drop is generated in at least one of the warp and weft directions of the woven material, as well as perpendicular to the surface of the woven material.

The present invention can use carrier gases such as nitrogen and carbon dioxide. Because of its low cost and availability, the preferred carrier gas is air that is free of impurities. Preferably, the carrier gas is substantially free of fibrous material. Preferably, carrier gas from the suction zone is recirculated to the supply zone, and any entrained particulate solid exiting the suction zone is recovered via a cyclone and fed to the supply zone.

When the carrier gas contains oxygen, it is desirable that it contains moisture as well. In such circumstances, the amount of moisture should be at a high enough level to prevent the build up of static charges, which can cause flashing of the particulate solid, and at a low enough level to prevent aggregation of the particulate solid—typically about 25% to about 35% w/w of moisture (with respect to the dry powder).

By their very nature, woven materials have greater dimensional instability than non-woven materials. This instability can be described in terms of two states—relaxed and stretched—states which non-woven materials do not possess. The gap size (and therefore permeability) of a woven material differs depending upon its state. As a woven material is stretched from its normal relaxed state, the size of each of the gaps is increased mechanically in size. This increases the material's permeability as well as its width (and/or length). Such increases in gap size adversely effect particulate incorporation due to the already minimal structural depth of a woven material. Therefore, it is preferred to operate in a relaxed state.

The level of incorporation of particulate solids in the woven material is dependent upon the following parameters: (1) concentration of particulate solid in the gaseous carrier stream; (2) rate of flow of gas into the supply zone; (3) rate of flow of gas out of the suction zone; (4) pressure drop between the first and second faces of the woven material; and (5) dwell time (i.e., the time during which the woven material is exposed to the flow of gaseous carrier and entrained particulate solid, which may be manipulated by adjusting the drive speed of the apparatus within the suction zone). These parameters can be manipulated in an iterative manner to achieve the desired particulate solid loading.

For example, to decrease particulate solid incorporation, the particulate solid feed level may be decreased, the rate of gas flow into and/or out of the supply and suction zones, respectively, may be decreased, the pressure drop between the first and second faces may be decreased, the dwell time in the incorporation zone may be decreased, or some combination of these steps may be used. Opposite steps could be taken to increase particulate solid incorporation.

Figure 5:
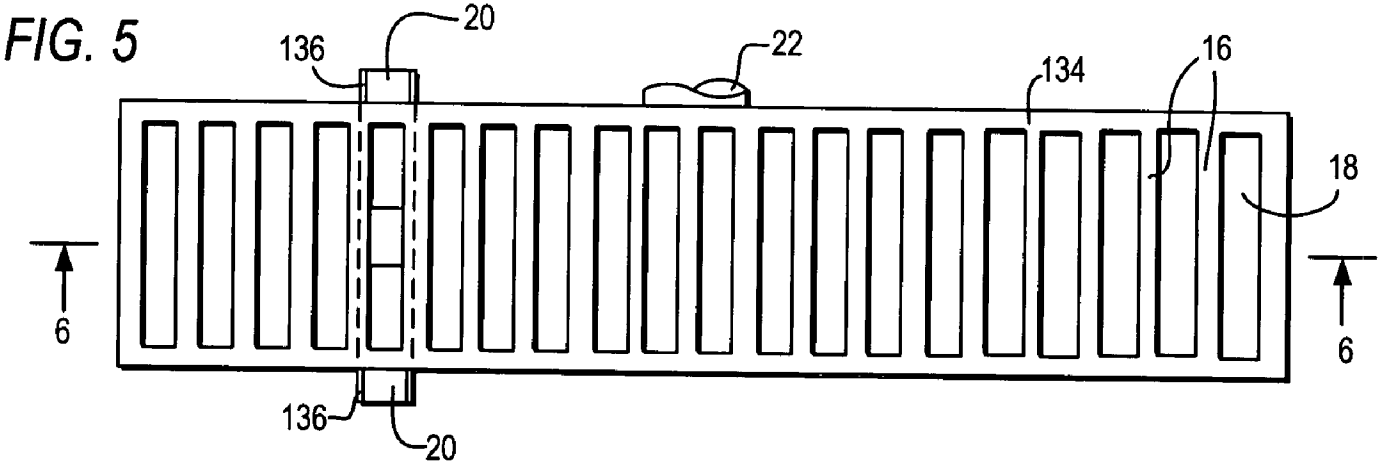
FIG. 5 is a plan view of the suction zone of the apparatus shown in FIG. 4, showing multi-directional control of the pressure drop.
Figure 6:
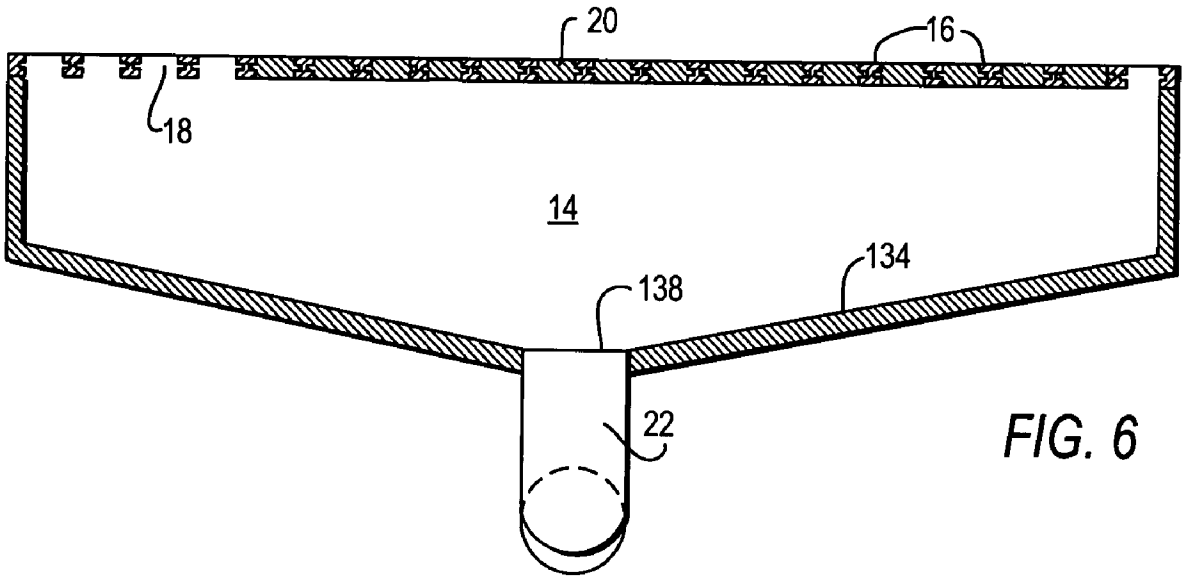
FIG. 6 is a cross-sectional view taken along line 6—6 of FIG. 5.

Woven materials, as opposed to non-woven materials, generally have a uniform distribution of gaps across a sheet of the woven material. A measure of uniformity of distribution of incorporation in the plane of the sheet is the variation in weight of particulate solid contained within panels of a given area (e.g., 80 $in^2$ or 0.0516 $m^2$) cut out from the sheet at intervals. In the process of this invention, a uniformity of ±10% can be expected. The desired distribution of particulate solids across a woven sheet being treated by the process of this invention can be achieved by adjusting air flow through the incorporation zone. For example, using the apparatus of FIG. 5 or 6, uniformity of particulate solid incorporation may be controlled by adjusting the slats 20. If the outer portions of the base woven material incorporated less particulate solid than the center, the slats beneath the outer portions of the base material may be adjusted to achieve a larger opening, which will result in additional gaseous carrier and particulate solid flow. Conversely, the slats beneath the center portions of the base material may be adjusted to achieve a smaller opening, thus decreasing gaseous carrier and particulate solid flow at the center of the material.

In one embodiment of a process of the present invention, a chemical binder is used to fix the particulate solid on and/or in the woven material. Such binders may be natural or synthetic latexes, including aqueous latexes. Suitable binders for use in a process of the present invention include, for example, natural rubber latex, NEOPRENE, styrene butadiene, acrylic/acrylonitrile copolymer, modified n-butyl acrylonitrile copolymer, acrylonitrile polyvinyl acetate, polyacrylate, acrylonitrile butadiene, acrylic methyl methacrylate, self cross linking copolymers of vinyl acetate and ethylene, polyvinyl alcohol, polyvinyl acetate, vinyl chloride copolymers, melamine-formaldehyde resins, solutions of starch, carboxymethyl cellulose, methyl cellulose, sodium silicate, and siloxanes, including functionalized siloxanes, or combinations of the above (provided that each component of the combination should be compatible with each other component). The woven material can be treated with the binder before and/or after the incorporation of particulate solids.

In a preferred embodiment of the present invention, the binder is a latex binder, and is more preferably, modified acrylonitrile copolymer. A solution of the binder material is preferably used and applied in excess. There are numerous ways to apply the binder solution to the woven material and control the amount of binder that remains on the woven material. For example, binder can be applied by spraying, padding, laying of foam or using suction. In a preferred embodiment, the woven material is held between two wire meshes during treatment with the binder liquids.

If a soluble binder is used in a granular or powder form, it can be entrained in the gaseous carrier together with the particulate solid and deposited on the woven material. In situ binding can then be achieved by wetting the woven material with sufficient solvent to dissolve or swell the soluble binder. For example, powdered polyvinyl alcohol can be entrained in the gaseous carrier together with the particulate solid and deposited on the woven material. The woven material can then be wetted by water to dissolve the polyvinyl alcohol particles and form the binder in situ.

After the woven material is treated with binder, it may, if necessary, be dried and fixed or cured by various methods, i.e., hot air, radiant heat, heated cylinders, etc.

If a thermoplastic binder is used in a granular or powder form, it can be entrained in the gaseous carrier together with the particulate solid and deposited on the woven material. In situ binding can then be achieved by heating the woven material to a temperature sufficient to raise the thermoplastic binder above its glass transition temperature.

The amount of binder used should be sufficient to bind the particulate solid to the woven material without affecting adversely the woven material. If too little binder is used, the particulate solid will not be adequately bound to the woven material (i.e., the particulate solid may fall off of the material). If too much binder is used, the fabric properties of the woven material may be lost. In one embodiment, binder pickup is about equal to about 16% w/w. In a preferred embodiment the binder pickup is about 10% w/w to about 13% w/w.

As stated above, the amount of binder remaining on the treated woven material can be controlled as follows. If too much binder is being applied, the binder solution may be diluted. If too little binder is being applied, additional binder may be added to the binder solution to increase its concentration. In addition, drive speed may be adjusted to increase or decrease binder loading by increasing or decreasing the amount of time spent in the binder section. Minimum and maximum binder loadings are limited by the base material and the level of particulate solid incorporation.

In certain embodiments of this invention, contact between the particulate solid and the free flowing binder is minimized, thereby minimizing encapsulation of the particulate solid. This reduces the amount of particulate solid necessary to achieve the desired material performance, and assures that the resulting woven material with incorporated particulate solids will retain its woven nature rather than assume the properties of the particulate solid. In these embodiments, the short contact times between the particulate solid and the free flowing binder makes it possible to use non-compatible binders, i.e., binders which would precipitate out of solution or suspension on prolonged contact. This is an advantage over methods, such as liquid dispersion or suspension methods, that have too long a contact time to use a non-compatible binder.

Thus, the present invention allows the use of a wide range of binders to meet different circumstances without, for example, materially increasing the cost of production.

In another embodiment of the present invention, no chemical binder is used. In this embodiment, a particulate solid, such as activated carbon, is first incorporated into the woven material. After incorporation, the activated carbon is irradiated with infra-red energy of a suitable wavelength to cause localized heating. This localized heating thermally induces bonding of the activated carbon to the woven material. This process avoids a chemical binding agent.

A process of the present invention has a number of advantages over prior art methods. It allows incorporation of a particulate solid(s) into a woven material, without loss of the woven nature of the material, and consequently allows the use of more stretchable materials; it allows the use of a wider range of fabric weights and thicknesses than processes involving non-woven materials; it lend itself to continuous operation; it results in little or no loss in the activity of incorporated particulate solids; it can provide products having high levels of gas and liquid permeability; it can provide products with improved wearability, wicking, UV absorption, antibacterial, antifungal or antimicrobial properties; and/or it allows high levels of particulate solid incorporation, up to about 70% w/w based on dry weight of woven material, before incorporation of binder material.

DETAILED DESCRIPTION OF THE FIGURES

An apparatus for practicing a process according to this invention may have three main components: (1) a solids incorporation section; (2) a binder section; and (3) a drying section. The solids incorporation section can either precede or follow the binder section. In addition, the apparatus can be operated without using a binder section. FIGS. 1–4, and the description below, involve an embodiment wherein a binder section is present, and the solids incorporation section is before the binder section.

Solids Incorporation Section:

Fabric 3 is supplied to the solids incorporation zone 6 from a fabric source. This source could be a knitting machine, a weaving machine, a roll of fabric, a fold of fabric, or any other means for supplying and handling fabric. In FIG. 1, this source is a roll positioned on the unwind 1.

The woven material is fed into the solids incorporation section supported on an air permeable conveyor belt 8. This air permeable conveyor belt may be constructed of wire mesh, as is depicted in FIG. 1, or any other air permeable material. The air permeable conveyor belt is driven by a motor. As depicted in FIG. 1, the air permeable conveyor belt 8 travels in a continuous loop over a set of rollers 10, 12. A vacuum, brush, air blower, or other means can be used to keep the air permeable conveyor clean during use.

The woven material 3 can be held in place on the air permeable conveyor as it passes through the solids incorporation zone through use of suction from below (from the suction zone), picker fingers, pressure from above, or any other means which will not prevent a pressure drop across the woven material 3. In FIG. 1 the woven material 3 is held in place on the air permeable conveyor by suction from below, generated by a blower or fan in the suction zone.

Solid particulates are introduced into the incorporation zone 6 from an inlet 2. The solid particulate is dispersed in the gaseous carrier. This can be achieved by a hammer mill, jet mill or any other means for breaking up and dispersing solid particulates. A blower, fan, pump, pressurized tank or other means to supply pressure for the gaseous carrier can also be used to aid in dispersing the solid particulates in the gaseous carrier.

Figure 6A:
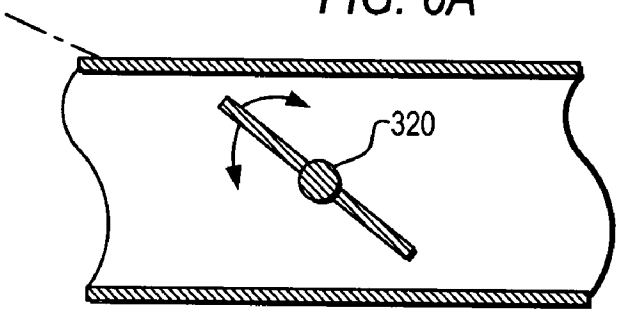
FIG. 6*a* is a cross-sectional view taken along the encircled portion of FIG. 5*a*.
Figure 5A:
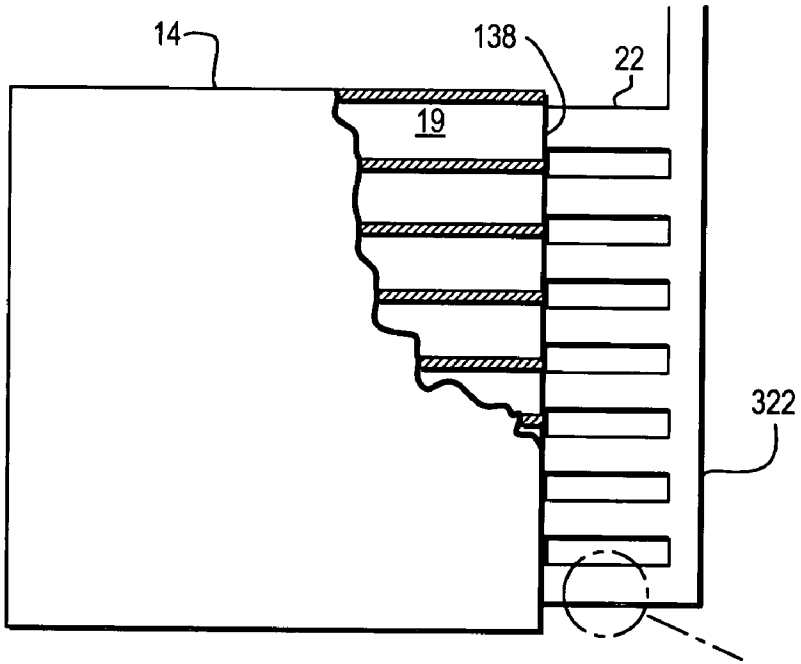
FIG. 5*a* is plan view of an alternative suction zone part showing uni-directional control of the pressure drop.

Suction is generated beneath the air permeable conveyor belt 8 by using a vacuum, a blower, a fan or any other means. In FIG. 1, suction is generated by drawing air out of outlet pipe 22. The suction box 14 contains airflow controls to evenly distribute the pressure drop across the woven material. The suction box 14 also maintains the woven material in contact with the wire-mesh 8. The even distribution of pressure drop may be achieved by using multiple zones controlled using baffles, butterfly valves, sliding barriers, slats, or any other means for varying gas flow. The system, shown in further detail in FIGS. 5 and 6, uses slats 20 and gaps 18 to control the gas flow (i.e., from inlet 2 through outlet pipe 22) and thereby evenly distribute the pressure drop across the woven material. The slats are adjustable such that the size and position of the gaps may be varied to obtain the desired gas flow. The number of slats used depends on the size of the solids incorporation chamber and the desired level of gas flow control. The slats have groves 136 that fit into groves 16 and are held by frame 134. Gas flows from suction box 14 through outlet pipe 22 via opening(s) 138, as depicted in FIGS. 5A and 6A (see below).

Incorporation zone 6 is defined by walls 26, 28. It may be desirable to avoid having a pressurized incorporation zone 6. In FIG. 1, this is avoided by having gap 28*a* in wall 28 to allow air to pass into the incorporation zone 6. Gap 28*a* also allows fabric to pass more easily out of the incorporation zone. A filter unit (not shown) may be provided to prevent particulate solid from leaving the incorporation zone 6 through gap 28*a*.

The woven material exiting the solids incorporation section is depicted as 36.

Figure 3:
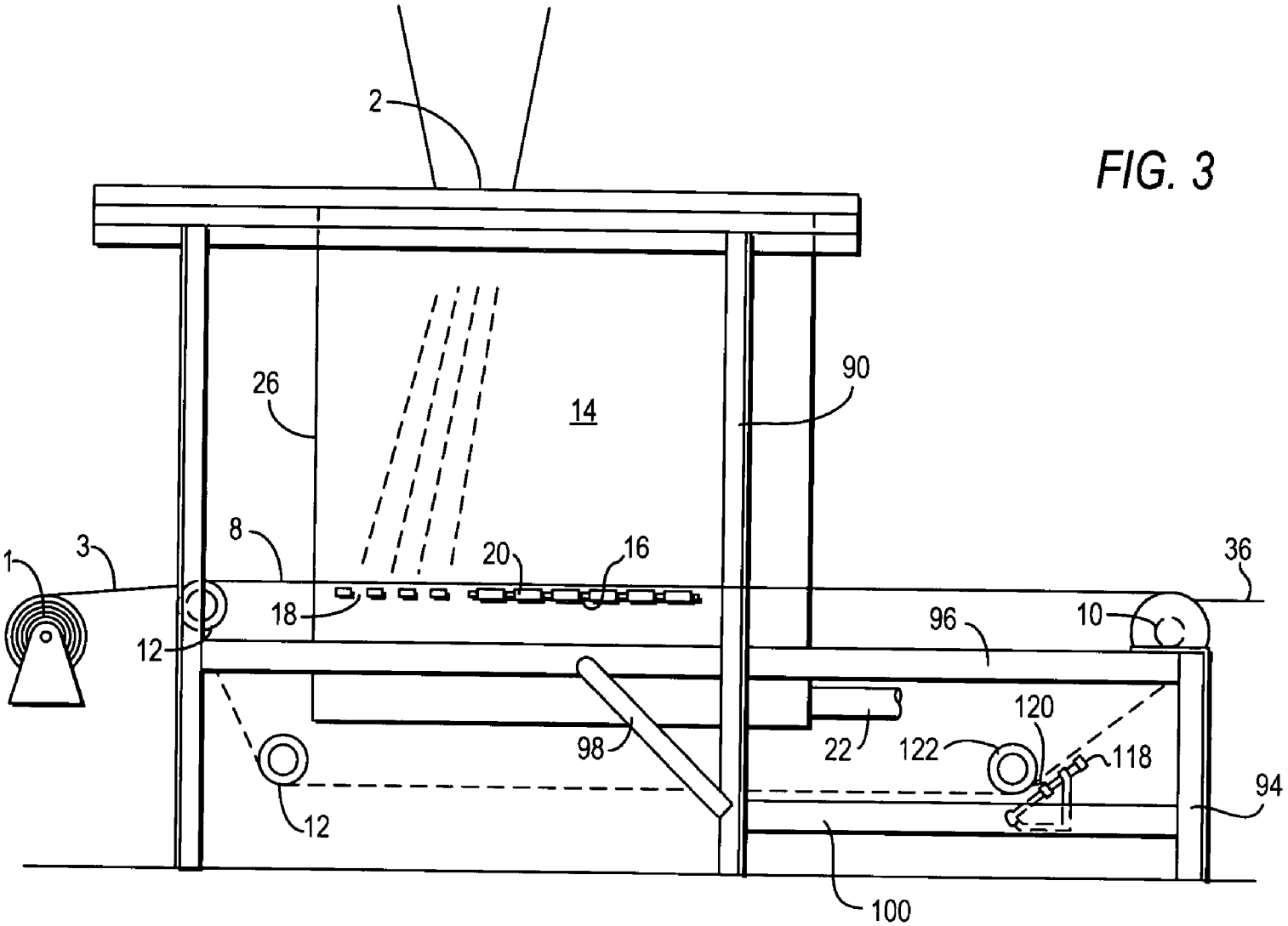
FIG. 3 is a detailed view of one apparatus suitable for performing a process of the present invention.

More specifically, FIG. 3 is a detailed view of one apparatus suitable for performing a process according to this invention. In FIG. 3, the apparatus is mounted in a frame having angle irons 94, 96, 98, 100. Carrying roller 122, frame 120, and screw 118 are also depicted.

Figure 4:
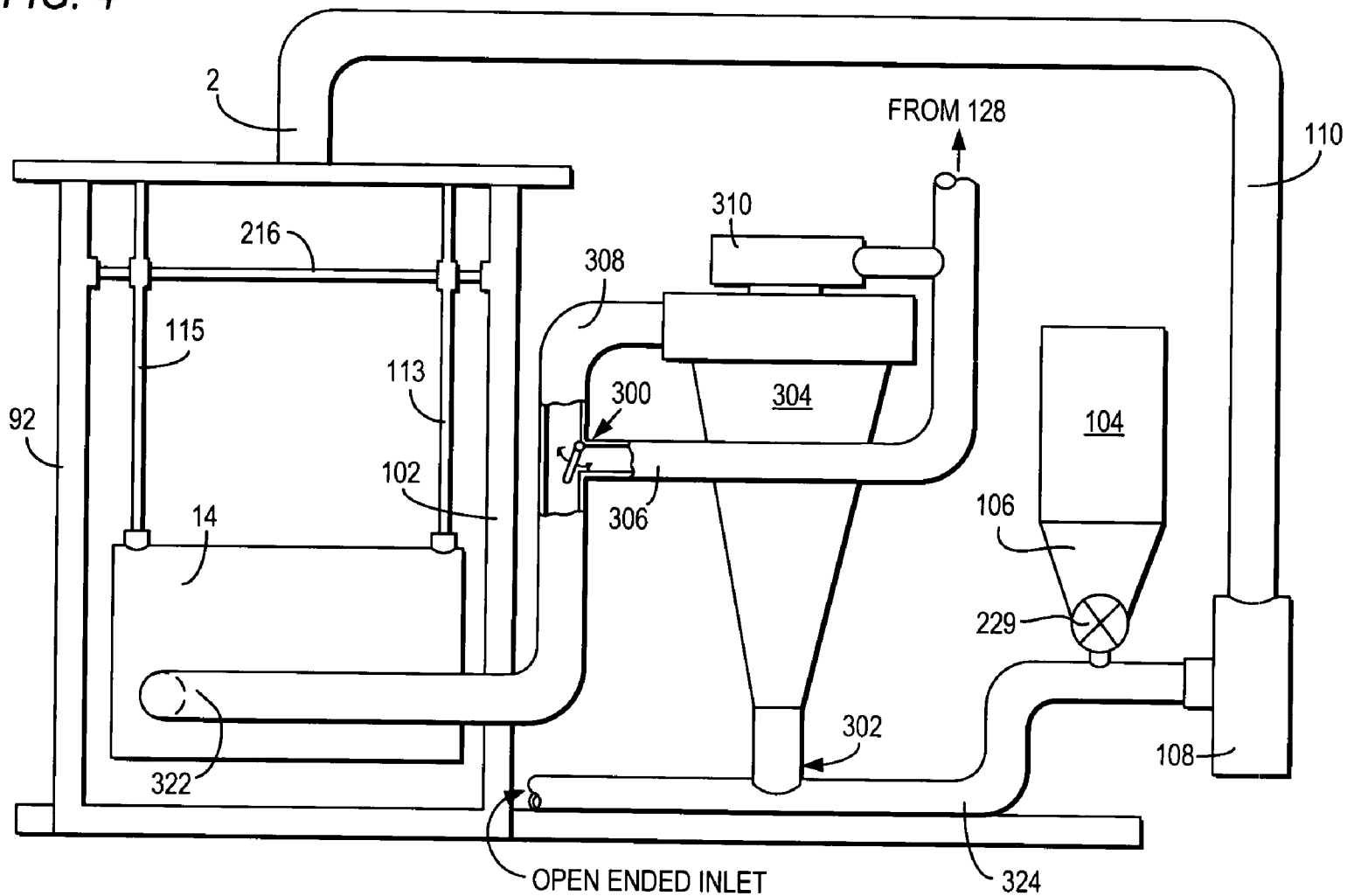
FIG. 4 is an end view of the apparatus shown in FIG. 3 and including a cyclone.

FIG. 4 is an end view of the apparatus shown in FIG. 3 and includes a cyclone 304. Side walls 113 and 115 may slide along bar 216 to accommodate different widths of material. The frame that houses the apparatus has further angle irons 92, 102. Particulate material is fed from hopper 104 by the screw feeder 106 to pipe 324 by way of rotary valve 229. The particulate material is then carried via pipe 110 to inlet 2. It has been found expedient to incorporate some form of rotary seal between hopper 104 and outlet pipe 22 to prevent variations in the feed from occurring and also to prevent leakage into the system of more air causing pressure variations.

Air is drawn from the suction box through outlet pipe 22 and into manifold 322 by fan 128. Carrier gas that still contains some entrained particulate material and is passed through a cyclone 304 before being vented to atmosphere. The proportion of carrier gas passing through the cyclone can be regulated using bypass valve 300 and fed either into pipe 308 or pipe 306. Carrier gas which is largely devoid of entrained particulate matter flows from the upper section of the cyclone 310 in accordance with the normal operation of such devices. Particulate solid which has been removed from the gas carrier stream is fed, via a rotary valve 302 into a pipe 324, which is an open ended inlet to rotary valve 229 and fan 108.

Referring to FIGS. 5A and 6A, a series of openings 138 is provided to remove air from the suction box 14. A number of channels 19 which can be opened or closed to provide lateral directional control of the air flow. This is achieved by varying the amount of air passing through outlet pipe 22 by a series of butterfly valves 320 each of which are independently controlled by a series of linkages (not shown).

Figure 2:
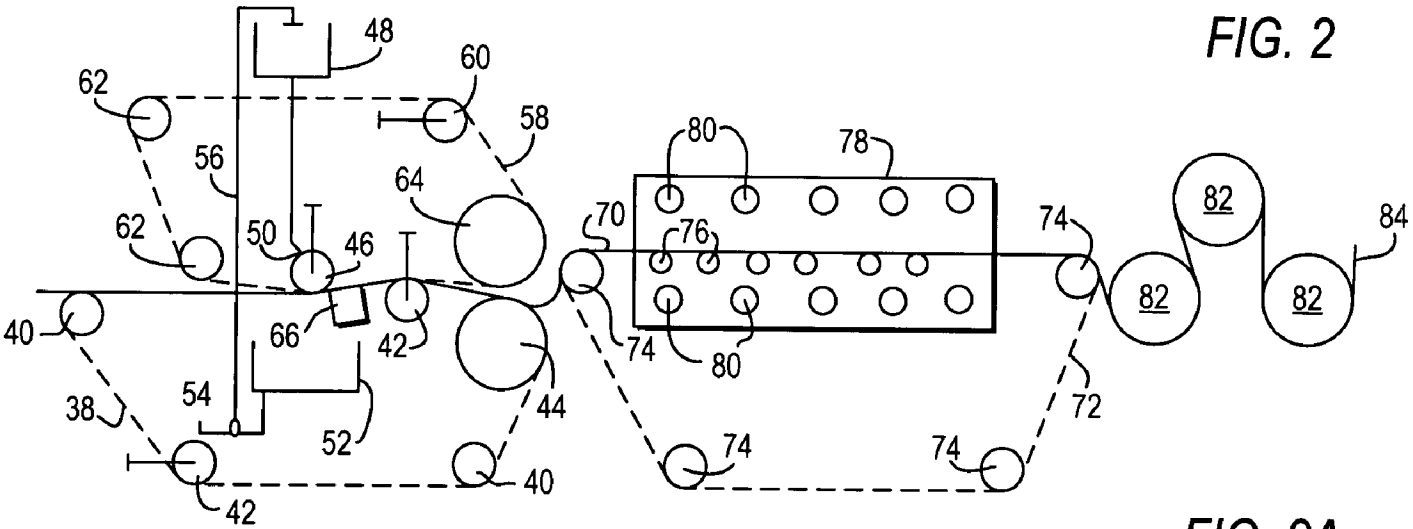

Binder Section:

The woven material exiting the solids incorporation section is fed into the binder section. Picker fingers, conveyor belts, pinch rollers or any other means may be used to grab the woven material exiting the solids incorporation section and bring it into the binder section. In FIG. 2, two liquid permeable conveyor belts 38, 58, one above the woven material and one below it, pull the woven material into the binder application portion of the binder section.

The conveyor belts 38, 58 control the woven material and pull it across a binder applicator. The means for applying binder will depend on the type of binder used, and its phase. The binder applicator can be an ink jet head, a sprayer, an extruder, a set of rollers, a doctor or knife blade, or any other conventional binder applicating means. In FIG. 2, the liquid binder is applied by a roll applicator 46 with a doctor blade 50 to evenly distribute the liquid binder across the roll applicator. The binder is supplied from reservoir 48.

After the binder is applied, suction on the top or bottom face of the fabric can be used to remove excess binder from the woven material. In FIG. 2, suction 66 is applied to the bottom face of the fabric to pull the binder through the woven material. The binder material thus obtained is recovered in a container 52 for reuse. A pump 54 delivers the binder from container 52 to reservoir 48 via pipe 56.

As depicted in FIG. 2, the liquid permeable conveyor belts 38, 58 travel in a continuous loop over a set of rollers 40, 42, 44, 60, 62 and 64. A motor is used to drive the conveyor belts 38, 58.

Drying Section:

A drying section is employed to fix, cure, and set the binder. The drying section also dries the treated woven material. The drying section follows both the solids incorporation section and the binder section. Picker fingers, conveyor belts, pinch rollers or any other means may be used to grab the woven material exiting the binder section and bring it into the dryer section. Gravity may also be used for this purpose, as is depicted in FIG. 2.

The drying section comprises a forced hot air convection oven, electric coil oven, infrared lamps, heating cans or any other means of delivering heat, independently or in combination. The drying section may be composed of one or more heating zones. If multiple zones are used, they may be at the same or different temperatures, and can use the same or different means of delivering heat. The total length of the drying section, and the heat settings used therein, is dependent on the woven material being used and the desired running speed.

FIG. 2 depicts the drying section as an infrared lamp chamber followed by steam drying cans. A wire mesh conveyor 72 feeds the woven material 70 into the infrared lamp chamber 78 via support rollers 76, where infrared lamps 80 heat the woven material and set the binder. After the woven material is fed through the infrared lamp chamber, it is passed over steam drying cans 82 to provide a treated woven material 84.

As depicted in FIG. 2, the wire mesh conveyor 72 travels in a continuous loop over a set of rollers 74. A motor is used to drive wire mesh conveyor 72.

Figure 2A:
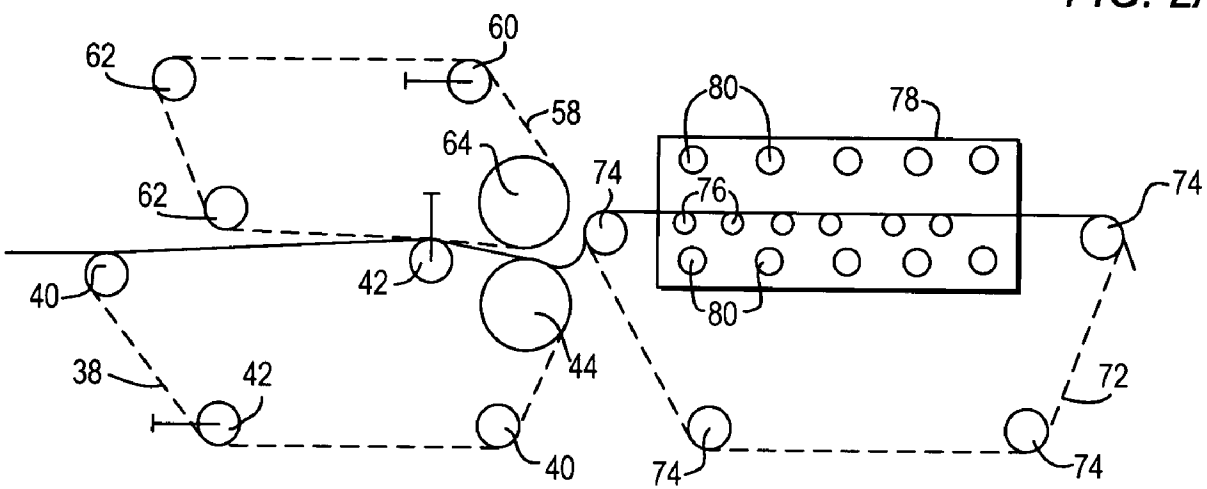

FIG. 2*a* depicts an embodiment of this invention wherein the curing step is carried out by infrared treatment without a subsequent heating step.

In order that this invention may be better understood, the following examples are set forth. These examples are for purposes of illustration only and are not to be construed as limiting the scope of the invention in any manner.

EXAMPLE 1

This example was performed using the apparatus illustrated in FIGS. 2–4 above. The woven base material, a blend of 59% cotton, 39% polyester and 2% lycra, was supported on the wire mesh conveyor belt 8 as it traveled through the incorporation zone located between the incorporation zone 6 and the suction box 14. To start up the process, the woven base material was placed on the wire mesh 8 in the material's relaxed state, i.e., no feed fingers or pins were used to stretch the material. The woven base material was then hand threaded into the inlet of the incorporation zone.

Once in the incorporation zone, the woven base material was held in place by suction from the suction box 14. The woven base material exiting the incorporation zone was then threaded between the wire mesh conveyor belts 38, 58, pulling the material through the binder zone. Rope was then tied to the end of the woven base material and hand threaded through the oven 78 and the steam cans 82. The rope was attached to the drive roll and used to pull the fabric through the oven and steam cans.

Activated carbon (steam activated) was obtained from Chemviron (manufacturer code BL). The activated carbon had a surface area of 900 $m^2/g$. The activated carbon was loaded into the hopper 104 and passed through the inlet 2 into the incorporation zone 6. The air/activated carbon mixture in the incorporation zone 6 was then pulled through the woven base material by suction from the suction box 14. Excess carbon was collected from the suction box 14 via the outlet pipe 22 and the manifold 322. This excess carbon was recovered via the cyclone 304 and recirculated to the incorporation zone 6.

The binder used was modified acrylonitrile copolymer latex produced by BASF (manufacturer code 35D). The binder was applied by the application roller 46. The spreader 50 was used to obtain an even distribution of binder on the application roller 46. Excess binder flowed into tray 52. Additional excess binder was removed by suction at the suction box 66, and passed to the tray 52. The excess binder solution in the tray 52 was recirculated to the binder feed tank 48.

The binder was cured by passing the treated fabric through the heater tunnel which was set at 120° C. Infra red lights were used in the heater tunnel to achieve the desired drying temperature. The treated fabric was then passed over the steam cans 82 to complete the drying of the treated fabric.

The desired level of activated carbon incorporation and binder pickup was achieved by the iterative process described herein. An initial drive speed, carbon feed level, air flow rate, and binder concentration were chosen (e.g., in this example, a binder concentration of 10% w/w was chosen). The woven base material was run through the process for a short period of time and then the level and uniformity of activated carbon incorporation and the level of binder pickup was determined. Adjustments to the process were then made as described herein, and the woven material was again run through the process for a short period of time to determine the level and uniformity of activated carbon incorporation and the level of binder pickup. A low carbon incorporation of 10 g/m$^2$ was targeted. This iterative process was determined to be complete when the level and uniformity of carbon incorporation (10 g/m$^2$) and level of binder pickup (13%) were achieved. At that point, the process was run continuously to provide woven material having a carbon incorporation of 10 g/m$^2$ and a binder pickup of 13%.

Details of the measured process parameters, including the concentration of binder used and the carbon loading achieved, are provided in Table 1, below.

EXAMPLE 2

The procedure described in Example 1 was repeated, but the targeted carbon incorporation was 70 g/m$^2$. Details of the concentration of binder used, the carbon loading achieved, and other measured process parameters are provided in Table 1, below.

EXAMPLE 3

The procedure described in Example 1 was repeated using a blend of 96% cotton and 4% lycra as the woven base material with a low targeted carbon incorporation of 8 g/m$^2$. Details of the concentration of binder used, the carbon loading achieved, and other measured process parameters are provided in Table 1, below.

EXAMPLE 4

The procedure described in Example 1 was repeated using the woven base material of Example 3, with a targeted carbon incorporation of 45 g/m$^2$. The target incorporation of 45 g/m$^2$ was between a low and a high target incorporation. Details of the concentration of binder used, the carbon loading achieved, and other measured process parameters are provided in Table 1, below.

EXAMPLE 5

The procedure described in Example 1 was repeated using a blend of 92% cotton and 8% lycra as the woven base material with a low targeted carbon incorporation of 17 g/m$^2$. Details of the concentration of binder used, the carbon loading achieved, and other measured process parameters are provided in Table 1, below.

EXAMPLE 6

The procedure described in Example 1 was repeated, except that two rolls of 100% cotton woven base material were run through the process consecutively. A low carbon incorporation was targeted. The targeted carbon incorporation was 14 g/m$^2$. Details concerning the concentration of binder used, the carbon loading achieved, and other measured process parameters obtained for the first roll are provided in Table 1, below (see 6a). After the targeted carbon incorporation had been achieved, the second roll of woven base material was introduced into the apparatus.

The procedure described in Example 1 was continued, and a carbon incorporation of 15 g/m$^2$ was obtained. Details of the concentration of binder used, the carbon loading achieved, and other measured process parameters obtained for the second roll are provided in Table 1, below (see 6b).

EXAMPLE 7

The procedure described in Example 1 was repeated using a 100% polyester woven base material with a targeted carbon incorporation of 20 g/m$^2$. Details of the concentration of binder used, the carbon loading achieved, and other measured process parameters are provided in Table 1, below.

TABLE 1

| Ex. No. | Base Material | Weight (g/m$^2$) | Width (mm) | Drive Speed (ft/min) | Carbon Loading (g/m$^2$) | Treated Carbon Activity (%) | Binder Conc. (% w/w) | Binder Moisture (%) | Binder Pickup (% w/w) | Dwell Time (s) |
|---|---|---|---|---|---|---|---|---|---|---|
| 1 | 59% Cotton, 39% Polyester, 2% Lycra | 285 | 1450 | 14 | 10 | >95 | 8.5 | 58 | 13 | 21 |
| 2 | 59% Cotton, 39% Polyester, 2% Lycra | 285 | 1450 | 9 | 70 | >95 | 8.5 | 58 | 13 | 33 |
| 3 | 96% Cotton, 4% Lycra | 217 | 1450 | 15 | 8 | >95 | 7.5 | 57 | 11 | 20 |
| 4 | 96% Cotton, 4% Lycra | 217 | 1450 | 11 | 45 | >95 | 7.5 | 57 | 11 | 27 |
| 5 | 92% Cotton, 8% Lycra | 75 | 1450 | 14 | 17 | >95 | 10 | 60 | 17 | 21 |
| 6a | 100% Cotton | 122 | 1525 | 13 | 14 | >95 | 10.21 | 54.34 | 13.53 | 23 |
| 6b | 100% Cotton | 122 | 1525 | 14 | 15 | >95 | 10.75 | 57.04 | 15.56 | 21 |
| 7 | 100% Polyester | 120 | 1500 | 14.7 | 20 | >95 | 11.18 | 56.09 | 16.08 | 20 |

EXAMPLE 8

The binder pickups in Table 1 were determined as follows: A 10 cm by 10 cm swatch of treated, but uncured (i.e., wherein the binder has not been dried, fixed or cured), woven material was put in a centrifuge at 3700 rpm for 4 minutes. This removed the activated carbon from the sample. The woven material with only the binder was placed in a microwave for 2 minutes to dry the sample. The resultant sample was weighed. The difference between the weight of the untreated and treated woven material was the weight of the binder in a 100 cm$^2$ sample.

The carbon loadings in Table 1 were determined as follows: The weight of incorporated activated carbon was determined by weighing a 10 cm by 10 cm swatch of treated, cured woven material and subtracting the weight of the binder and the weight of a 10 cm by 10 cm swatch of untreated woven material.

EXAMPLE 9

The activity of the activated carbon incorporated into the woven fabrics prepared in Examples 1–7, above, was determined as follows:

(a) A 10 cm×10 cm piece of woven fabric (whose level of carbon incorporation had already been measured by the technique described in Example 8) was dried to a constant weight by any means appropriate to drive off any absorbed or adsorbed materials.

(b) An amount of activated carbon equivalent to the amount incorporated into the fabric was placed beside the treated fabric in the oven.

(c) The woven fabric and activated carbon were then cooled to room temperature in a desiccant chamber.

(d) The dried/cooled fabric and the activated carbon were then weighed.

(e) The dried/cooled fabric and the activated carbon were then placed in a chamber with excess chloroform solvent vapors.

(f) The fabric from the chamber and the activated carbon were permitted to adsorb chloroform vapor for two hours, and then weighed every 30 minutes until a constant weight was achieved by both the fabric and the activated carbon, generally after about 4 hours. Longer amounts of time were required when higher carbon loadings were being tested.

(g) The ratio of the weight gain of the treated fabric compared to the weight gain of the activated carbon was then calculated. This ratio is a measure of the percentage of the incorporated carbon which remained active after incorporation in the treated fabric, and is referred to herein as the treated carbon activity. Table 1 summarizes the treated carbon activities measured for the carbon incorporated into the fabrics prepared in Examples 1-7.

EXAMPLE 10

The wicking properties of the treated 100% cotton fabric prepared in Example 6A, having a carbon incorporation of 14 g/m$^2$, were compared with the wicking properties of untreated 100% cotton jersey (i.e., the untreated base material in Example 6). The wicking properties were measured in a conditioned environment at 65% +/−2% relative humidity, and 70° F.+/−2° F., as follows:

(a) Two 1"×12" specimens for each fabric were tested. One specimen was cut with the long dimension in the wale (length) direction and the other in the course (width) direction of the fabric.

(b) Each strip of fabric was suspended vertically above a beaker containing deionized water and the bottom 1 inch was submerged below the surface of the water. The leading edge of the water line was then observed and the height of the water wicked into the fabric was measured at 30 second increments for 300 seconds.

The 300 second results of these wicking tests are summarized in Table 2, below. These results show that the treated fabric had a wicking height 1.9 to 3.8 times greater than that of untreated fabric.

TABLE 2

| | Treated Cotton (Ex. 6A) | Untreated Cotton | % Change |
|---|---|---|---|
| Wicking Height: Length (300 sec) | 7.5 | 4 inches | 188 |
| Wicking Height: Width (300 sec) | 7.2 | 1.9 inches | 379 |
| Wicking Height: Avg. (300 sec) | 7.35 | 2.95 | 249 |

EXAMPLE 11

The wicking properties of the treated 100% polyester fabric prepared in Example 7, having a carbon incorporation of 20 g/m$^2$, were compared with the wicking properties of CoolMax™ 100% polyester fabric (i.e., Dupont treated polyester). The wicking properties were measured in the same way as set forth in Example 10. The results of these wicking tests are summarized in Table 3, below. These results show that the treated fabric had a wicking height 1.3 times greater than that of 100% CoolMax™ polyester.

TABLE 3

| | Treated Polyester (Ex. 7) | Cool Max 100% Polyester | % Change |
|---|---|---|---|
| Wicking Height: Length (300 sec) | 9.2 inches | 7.4 | 124 |
| Wicking Height: Width (300 sec) | 10.5 inches | 7.8 | 135 |
| Wicking Height: Avg. (300 sec) | 9.85 inches | 7.6 | 130 |

EXAMPLE 12

The UV absorption properties of the treated 100% cotton fabric prepared in Example 6, having a carbon in corporation of 14 g/m$^2$, were compared with the absorption properties of an untreated 100% cotton jersey (i.e., the Example 6 base material). The UV absorption was measured using American Association of Textile Chemists and Colorants (AATCC) procedure 183, resulting in a more ultraviolet protection factor (UPF) rating. The results of these tests are summarized in Table 4, and show that the treated material has a UPF Rating 4 times greater than that of the untreated material (for the American Standard UPF rating system, see, AS/NZS 4399:1996).

EXAMPLE 13

The UV absorption properties of the treated 100% polyester fabric prepared in Example 7, having a carbon incorporation of 20 g/m$^2$ were compared with the UV absorption properties of CoolMax™ 100% polyester fabric. The UV absorption was measured using the same procedure as in Example 12. The results of these tests are summarized in Table 4, and show that the treated material has a UPF rating 3.3 times greater than that of the untreated material.

TABLE 4

| Material | UPF Rating |
|---|---|
| Untreated 100% Cotton | 5 |
| Treated 100% Cotton (Ex. 6A) | 20 |
| CoolMax ™ 100% Polyester | 15 |
| Treated 100% Polyester (Ex. 7) | 50 |

One skilled in the art will appreciate that the present invention can be practiced by other than the described embodiments, which are presented for purposes of illustration and not of limitation, and the present invention is limited only by the claims which follow.

We claim:

1. A process for producing a woven material with an incorporated particulate solid, the woven material having inherent woven characteristics, the process comprising:

a. entraining an active particulate solid in a gaseous carrier;

b. disposing a first face of a woven material in the path of a stream of the gaseous carrier and active entrained particulate solid;

c. maintaining a pressure drop across the woven material from the first face to a second face of said woven material, thereby to incorporate at least some of the active entrained particulate solid in the gaseous carrier within the weave of the woven material; and d. fixing the active incorporated particulate solid, wherein the inherent characteristics of the woven material is substantially maintained and the active incorporated particulate solid is able to react with external matter in contact with the woven material after the active incorporated particulate solid is fixed.

2. The process according to claim 1 wherein the direction of the pressure drop across the woven material is controlled.

3. The process according to claim 2 wherein the direction of the pressure drop across the woven material is controlled through the use of slats positioned beneath the woven material.

4. The process according to claim 1 wherein the woven material has a weight of less than or equal to about 20 oz/yd$^2$.

5. The process according to claim 4, wherein the woven material has a weight of about 3 oz/yd$^2$ to about 7 oz/yd$^2$.

6. The process according to claim 1, wherein the particulate solid has odor-adsorbing properties.

7. The process according to claim 1, wherein the particulate solid has moisture management properties.

8. The process according to claim 1, wherein the particulate solid has ultraviolet protection properties.

9. The process according to claim 1, wherein the particulate solid is activated carbon, silica gel, activated alumina, aluminum trihydrate, pot ash, baking soda, paramethoxy 2-ethoxyethylester cinnamic acid, zinc oxide, or titanium dioxide.

10. The process according to claim 1, wherein the active particulate solid is activated carbon.

11. The process according to claim 10, wherein the particulate solid is incorporated in an amount of about 10 g/m$^2$ to about 70 g/m$^2$.

12. The process according to claim 1, wherein the pressure drop is effected by applying suction to the second face of the woven material.

13. The process according to claim 12, comprising providing a supply zone, wherein the stream of gaseous carrier and entrained particulate solid are supplied directly to the first face of the woven material, and a suction zone for applying suction to the second face of the woven material.

14. The process according to claim 13, wherein at least some of any remaining entrained particulate solid is recirculated.

15. The process according to claim 14, wherein the gaseous carrier and entrained particulate solid are substantially free of fibrous material.

16. The process according to claim 1, wherein the particulate solid is thermally fixed in the woven material.

17. The process according to claim 16, wherein the thermal fixing is induced by the application of infra-red energy to the woven material.

18. The process according to claim 1, wherein the particulate solid is fixed in the woven material with the aid of a chemical binder.

19. The process according to claim 1 further comprising controlling the pressure drop to provide a substantially uniform distribution of the particulate solids across the woven material.

20. The process according to claim 19 wherein the controlling comprises altering the pressure distribution perpendicular to the woven material and across at least one of a width and a length of the woven material.

21. The process according to claim 1 wherein the direction of the pressure drop across the woven material is controlled through the use of butterfly valves positioned beneath the woven material.

22. The process according to claim 1 wherein the woven material is maintained in a relaxed state throughout at least a portion of the process for producing a woven material with a particulate solid incorporated therein.

23. The process according to claim 22 wherein the woven material comprises a plurality of gaps and the relaxed state is achieved by minimizing expansion of the gaps throughout at least a portion of the process.

24. The process according to claim 22 wherein the woven material is maintained in the relaxed state through use of picker fingers.

25. The process according to claim 1, wherein the incorporated particulate solid comprises at least 70% of the combined weight of the woven material and the particulate solid.

26. The process according to claim 1, wherein the incorporated particulate solid comprises about 1% to about 70% of the combined weight of the woven material and the particulate solid.

27. A process for producing a woven material with an incorporated particulate solid, the woven material having inherent woven characteristics, the process comprising:

a. entraining an active particulate solid in a gaseous carrier;

b. disposing a first face of a woven material in the path of a stream of the gaseous carrier and active entrained particulate solid;

c. maintaining a pressure drop across the woven material from the first face to a second face of said woven material, thereby to incorporate at least some of the active entrained particulate solid in the gaseous carrier within the weave and on the first face of the woven material; and d. fixing the active incorporated particulate solid, wherein the inherent characteristics of the woven material is substantially maintained and the active incorporated particulate solid is able to react with external matter in contact with the woven material after the active incorporated particulate solid is fixed.

28. A process for producing a woven material with incorporated particulate solid, the woven material having an inherent woven characteristics, the process comprising:

a. entraining an active particulate solid in a gaseous carrier;

b. disposing a first face of a woven material in the path of a stream of the gaseous carrier and active entrained particulate solid;

c. maintaining a pressure drop across the woven material from the first face to a second face of said woven material, thereby to incorporate at least some of the active entrained particulate solid in the gaseous carrier on the first face of the woven material; and d. fixing the active incorporated particulate solid, wherein the inherent characteristics of the woven material is substantially maintained and the active incorporated particulate solid is able to react with external matter in contact with the woven material after the active incorporated particulate solid is fixed.

* * * * *

UNITED STATES PATENT AND TRADEMARK OFFICE

CERTIFICATE OF CORRECTION

PATENT NO. : 6,998,155 B2
APPLICATION NO. : 09/864348
DATED : February 14, 2006
INVENTOR(S) : Gregory W. Haggquist and Richard A. Mellor It is certified that error appears in the above-identified patent and that said Letters Patent is hereby corrected as shown below:

Title Page in field (56), U.S. Patent Documents, citation 4,457,345, change “Bl ücher” to --Blücher--.

Title Page, page 2, in field (56), U.S. Patent Documents, citation 5,538,783 change “Korpman” to --Hansen et al.--.

Column 2, line 35, insert --to-- before “provide”.

Column 2, line 66, insert --a-- after “is”.

Column 5 line 48, delete “to” before “enhance”.

Column 9, line 26, change “lend” to --lends--.

Column 10, line 62, delete “and”.

Column 11, line 8, delete “which”.

Column 16, line 46, change “in corporation” to --incorporation--.

Column 19, line 2, delete “an” at end of line.

Signed and Sealed this

Third Day of April, 2007

JON W. DUDAS
*Director of the United States Patent and Trademark Office*